US010287057B2

(12) United States Patent
Nilsson et al.

(10) Patent No.: US 10,287,057 B2
(45) Date of Patent: May 14, 2019

(54) STORAGE DEVICE AND IMPROVED BASKET STRUCTURE WITH HOOKS

(71) Applicant: Elfa International AB, Vastervik (SE)

(72) Inventors: Peter Nilsson, Vastervik (SE); Grand Tsai, Taichung (TW)

(73) Assignee: Elfa International AB, Vastervik (SE)

( * ) Notice: Subject to any disclaimer, the term of this patent is extended or adjusted under 35 U.S.C. 154(b) by 0 days.

(21) Appl. No.: 15/505,245

(22) PCT Filed: Aug. 19, 2015

(86) PCT No.: PCT/SE2015/050880
§ 371 (c)(1),
(2) Date: Feb. 20, 2017

(87) PCT Pub. No.: WO2016/028209
PCT Pub. Date: Feb. 25, 2016

(65) Prior Publication Data

US 2017/0259959 A1 Sep. 14, 2017

(30) Foreign Application Priority Data

Aug. 21, 2014 (TW) ..... 103128884 A
Dec. 15, 2014 (EP) ..... 14197923

(51) Int. Cl.
*B65D 25/22* (2006.01)
*A47B 57/16* (2006.01)
(Continued)

(52) U.S. Cl.
CPC ..... *B65D 25/22* (2013.01); *A47B 57/16* (2013.01); *A47B 57/40* (2013.01); *A47B 57/48* (2013.01);
(Continued)

(58) Field of Classification Search
CPC . B65D 25/22; B65D 7/06; B65D 7/20; B65D 7/44; A47F 5/0031; A47F 5/101
(Continued)

(56) References Cited

U.S. PATENT DOCUMENTS 3,229,823 A 1/1966 Hummer
3,559,836 A * 2/1971 Pink ..... B65D 7/20 206/557
(Continued)

FOREIGN PATENT DOCUMENTS

CA 2638487 A1 2/2009
DE 202005002708 U1 5/2005
(Continued)

OTHER PUBLICATIONS

International Search Report and Written Opinion received in Patent Cooperation Treaty Application No. PCT/SE2015/050880, dated Dec. 9, 2015, 10 pages.
(Continued)

*Primary Examiner* — Kareen K Thomas
(74) *Attorney, Agent, or Firm* — Hubbard Johnston, PLLC

(57) ABSTRACT

The present disclosure relates to a storage device made of expanded metal mesh material. The storage device comprises a basket (3, 5, 7, 9) with an attached fastening device (11). The fastening device has a portion with U-shaped cross section (21) provided with hooks (13) in the interior thereof, such that the fastening device can be fitted on a vertical carrier provided with slots, the hooks (13) entering said slots, and the fastening device is at least partly inserted in the outer envelope of the basket and has a portion (25) extending under the bottom panel of the basket.

16 Claims, 13 Drawing Sheets

(51) Int. Cl.

| | |
|---|---|
| ***A47B 57/48*** | (2006.01) |
| ***A47F 5/00*** | (2006.01) |
| ***A47F 5/10*** | (2006.01) |
| ***B65D 6/02*** | (2006.01) |
| ***B65D 6/08*** | (2006.01) |
| ***B65D 6/34*** | (2006.01) |
| ***A47B 57/40*** | (2006.01) |
| *A47B 96/06* | (2006.01) |

(52) U.S. Cl.
CPC ..... *A47F 5/0031* (2013.01); *A47F 5/101* (2013.01); *B65D 7/06* (2013.01); *B65D 7/20* (2013.01); *B65D 7/44* (2013.01); *A47B 96/061* (2013.01)

(58) Field of Classification Search
USPC ..... 220/485–495
See application file for complete search history.

(56) References Cited

U.S. PATENT DOCUMENTS 3,935,958 A * 2/1976 Frangos ..... A47L 15/0076 220/488
4,058,233 A * 11/1977 Frangos ..... A47L 15/502 220/23.2
4,109,797 A * 8/1978 Brunette ..... A47F 5/12 108/108
4,122,955 A * 10/1978 Celms ..... A47F 5/13 108/108
4,151,917 A * 5/1979 Pugh ..... A47B 57/42 211/182
4,254,944 A * 3/1981 von Matern ..... B21F 27/12 228/184
4,431,408 A * 2/1984 Postich ..... B65D 7/20 206/513
6,401,996 B1 * 6/2002 Thom ..... B65D 11/1873 224/407
7,428,976 B2 * 9/2008 Cheng ..... A47B 55/02 220/485
8,006,858 B2 * 8/2011 Cheng ..... A47B 55/02 220/485
8,919,572 B1 * 12/2014 Westaby ..... B01D 35/28 210/167.18
9,398,819 B2 7/2016 Tsai et al.

FOREIGN PATENT DOCUMENTS

| | | | |
|---|---|---|---|
| EP | 2218355 | A1 | 8/2010 |
| GB | 909033 | A | 10/1962 |
| WO | 2004112541 | A1 | 12/2004 |

OTHER PUBLICATIONS

Office Action received in Russian Application No. 2017106601/12(014460), dated Jan. 18, 2019, 4 pages.

* cited by examiner

Fig 5
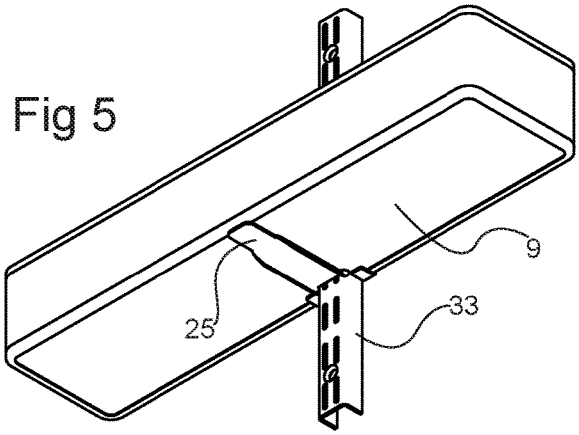
Fig 6
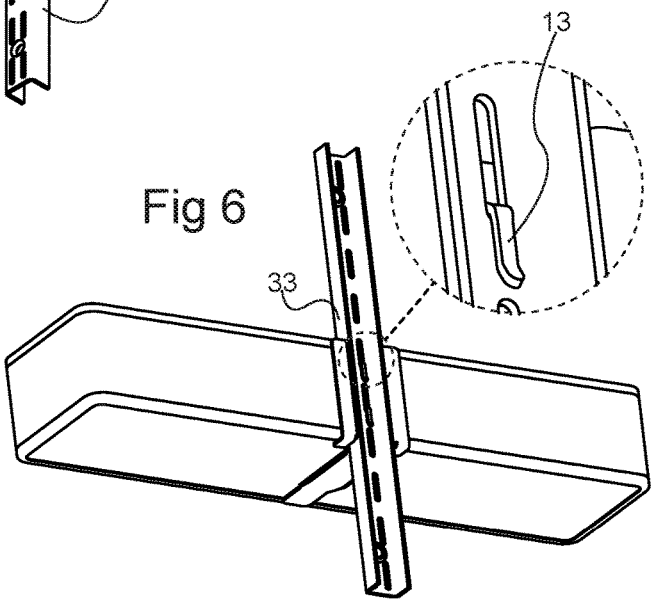
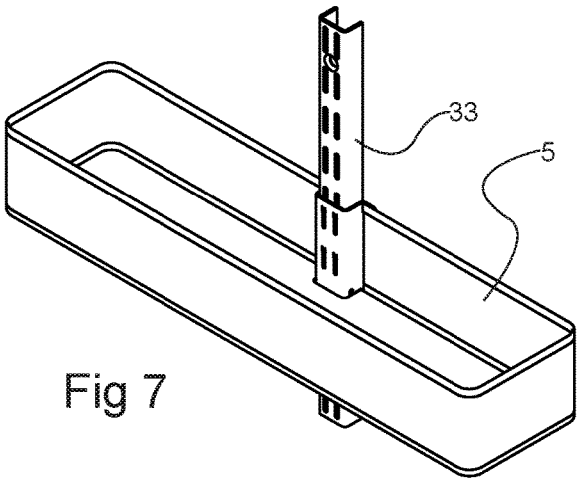
Fig 7

STORAGE DEVICE AND IMPROVED BASKET STRUCTURE WITH HOOKS

RELATED APPLICATION

This application, a national phase application of PCT/SE2015/050880, filed Aug. 19, 2015, which claims priority to Taiwanese Application No. 103128884 filed Aug. 21, 2014, U.S. application Ser. No. 14/512,865 filed Oct. 13, 2014 and European Application No. 14197923.7 filed Dec. 15, 2014.

TECHNICAL FIELD

The present disclosure relates to a storage device comprising a basket and a fastening device attached thereto, the fastening device having a portion with U-shaped cross section provided with hooks in the interior thereof, such that the fastening device can be fitted on a vertical carrier provided with slots, the hooks entering said slots, wherein the fastening device is at least partly inserted in the outer envelope of the basket.

BACKGROUND

Such a storage device is disclosed in WO-2004/112541-A1, which discloses e.g. a wire basket with a fastening device that allows the basket to be releasably attached to a vertical carrier element, which is provided with slots.

A problem associated with such storage devices is how to make the storage device more versatile, e.g. capable of storing smaller objects.

SUMMARY

One object of the present invention is therefore to obtain a more versatile storage device. This object is achieved by means of a storage device as defined in claim 1. More particularly, a storage device of the initially mentioned kind then has a basket being formed by expanded metal mesh panels, and a fastening device having a portion that extends under a bottom panel of the basket. This provides a basket capable of storing small objects and at the same time capable of carrying a reasonable load.

The fastening device may be made in one piece of sheet metal having a vertical section and a horizontal section, provided with a tongue, and a bend therebetween, and the U-shaped form of the vertical section partly can continue past the bend in such a way that reinforcement flanges are provided at least along a part of the tongue, and extending out of the plane of the tongue. The tongue may extend to at least half of the basket bottom panel's depth.

Unstretched areas may be provided at top or bottom edges of the mesh panels of the front, rear and side panels of the basket. This makes it possible to provide smooth edges by folding the unstretched material.

BRIEF DESCRIPTION OF THE DRAWINGS

FIGS. 5-7 show different perspective views of a storage device attached to a vertical carrier.

DETAILED DESCRIPTION

The present disclosure relates to a storage device. As initially mentioned, WO-2004/112541-A1 discloses a storage device in the form of a metal wire basket that can be attached, at a desired location, to a vertical element in the form of a metal profile with U-shaped cross section, which profile is provided with one or more rows of slots. Such carrier elements are well known per se and are widely used in end user configurable storage systems. The carrier element is attached to a wall, a door or similar vertical surface e.g. by means of screws. Alternatively, carrier elements are connected to a stand with feet that allows a storage system to be deployed at a given location on a floor surface.

Traditionally, when two or more such vertical elements have been attached e.g. to a wall, brackets may be attached to the slots of the carrier elements, and shelves may be placed on the brackets to provide a storage system with shelves. The aforementioned document discloses another way of attaching a storage device to a carrier element without the use of brackets or the like. A fastening device is fixedly attached to, or formed in one piece with, a storage device such as a basket. The fastening device may be a U-shaped profile which is large enough, but only just, to accommodate a vertical carrier and comprises hooks that can be inserted into the slots of the vertical carrier in order to provide a releasable connection that is both capable of suspending a significant load, and to provide a stable connection. The fastening device may be attached to the storage device in a recess thereof, such that it is more or less contained in the outer contour of the basket or the like, thereby allowing the storage device to be tightly fitted against e.g. the wall to which the carrier element is fixed.

One drawback with a wire basket of the known kind is that there, for a given basket, is a lower limit with regard to how small objects that can be stored, determined by the distance between adjacent wires. If objects smaller than that limit are stored, say toy marbles, the result may be annoying the user as object fall out. The obvious solution to this problem is to provide baskets with more wires so as to decrease the distance between adjacent wires. However, this solution may be expensive, especially if a spot weld is to be provided at each or most wire crossings.

Figure 18:
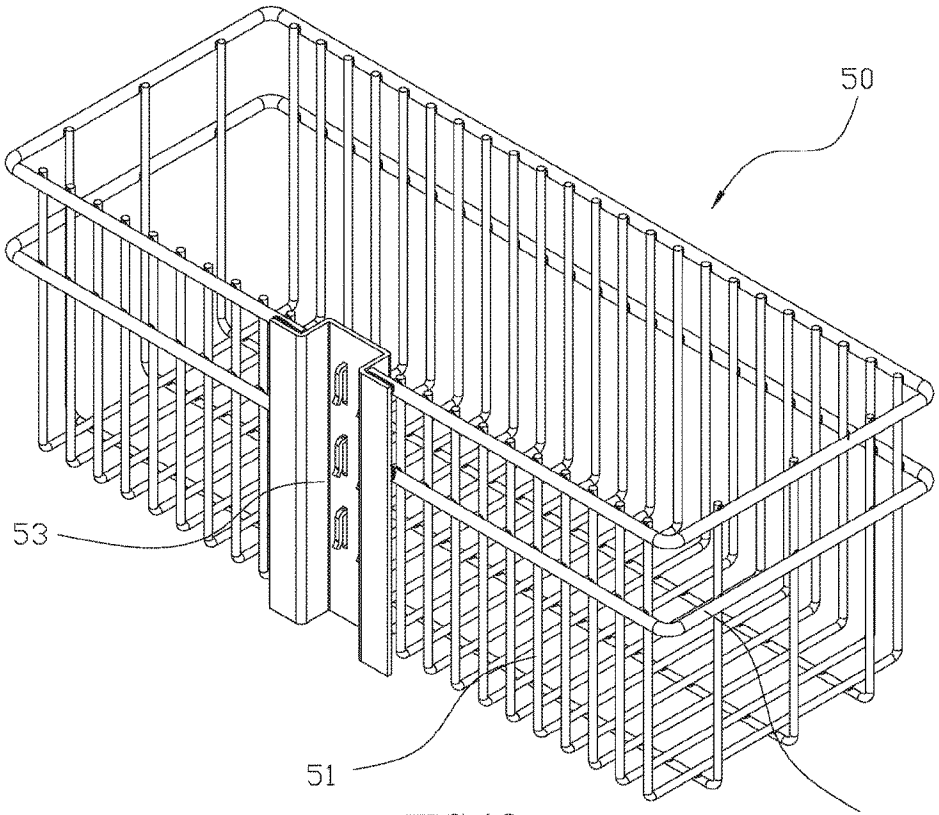
FIG.18 PRIOR ART
FIG. 18 illustrates prior art.

FIG. 18 shows a conventional basket, which includes a basket 50 made by a plurality of U-shaped iron wires/rods 51 arranged with each other and connected with at least two connecting rods 52 through soldering, and a hook unit 53 is soldered on one side thereof. However, the conventional basket is disadvantageous because the iron rods 51 are connected by soldering, which causes inconvenience in the manufacturing process. Also, the structural strength may not be strong enough because the basket is made through soldering. Furthermore, the gap between each iron rods 51 is large, so the objects may fall out from the gap.

A basket may include a basket frame, a hook assembly and a bottom. The basket frame has a meshed unit, and an upper board and lower board extending from the meshed unit. The upper board has a side frame with reversed U shape, and the lower board has an L-shaped portion. It is noted that the side frame can be either bent inside or outside, and a protruding unit is disposed on the side frame. The hook assembly is disposed at a predetermined position on the basket frame. The hook assembly has a recessed engaging slot and a hook unit on the surface thereof. A wing extends from both sides of the hook assembly, and is disposed on both ends of the basket frame to connect the basket frame. A reinforced unit is disposed at a bottom portion of the hook assembly, and the reinforced unit and the hook assembly are formed as an L-shaped unit. A reinforced point is formed at the bent portion of the L-shaped unit. It is noted the reinforced unit is a board to connect the L-shaped portion of the basket frame. The bottom is a meshed board corresponding to the L-shaped portion of the basket frame.

The present invention is advantageous because (1) the basket frame is made in one piece to avoid soldering, which would decrease the structural strength of the basket, and (2) the upper board has a side frame with reversed U shape and the lower board has an L-shaped portion to enhance the structural strength of the basket frame, so the bottom can sustain heavier objects. Also, the basket frame and the bottom are all meshed, the objects are unlikely to fall out from the basket. The present disclosure provides a storage device made of an expanded metal mesh material. Such a material, as is well known per se, is provided by shearing slits in a sheet metal plate, and stretching the plate perpendicularly with regard to the slits, such that the plate expands while exposing rhombus shaped openings. The mesh material can be folded e.g. into a box shape.

Figure 1:
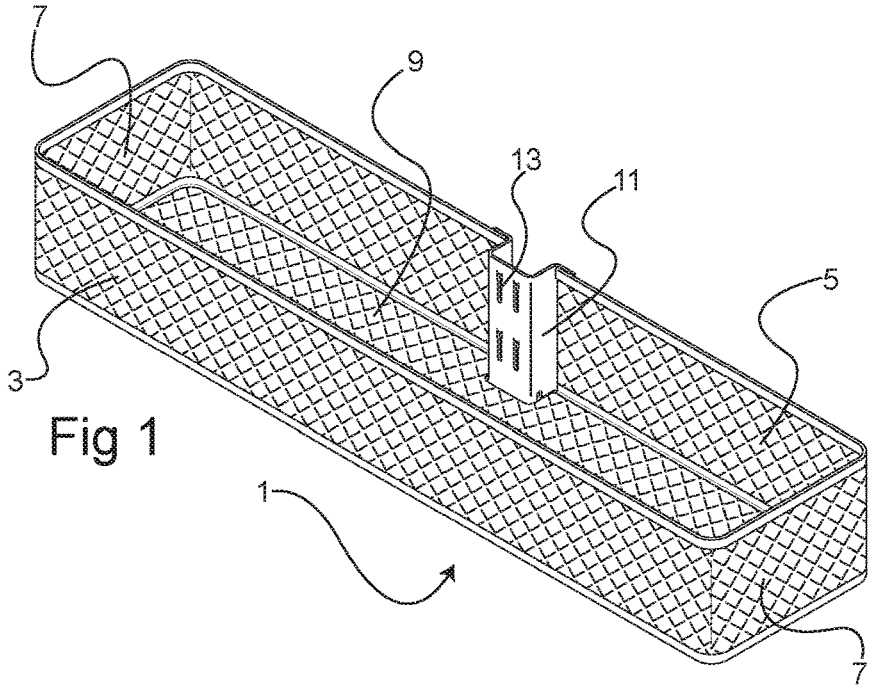
FIGS. 1 and 2 show perspective views of storage devices with two different sizes.

FIG. 1 shows a perspective view of a storage device/container 1 made from mesh material. The mesh material is indicated with a symbol hatching, as such fine structures would make the entire area appear black in the drawings. As can be expected, the storage device/container 1 has front 3 and rear 5 walls, as well as side walls 7 and a bottom or bottom piece 9, which in the illustrated case are all made from mesh material. However, different material combinations could be considered such as having an unstretched sheet metal bottom piece. The storage device/container 1 has a fastening device/hook assembly 11 with four hooks 13 in the form of punched-out tongues, as will be discussed further later.

Figure 2:
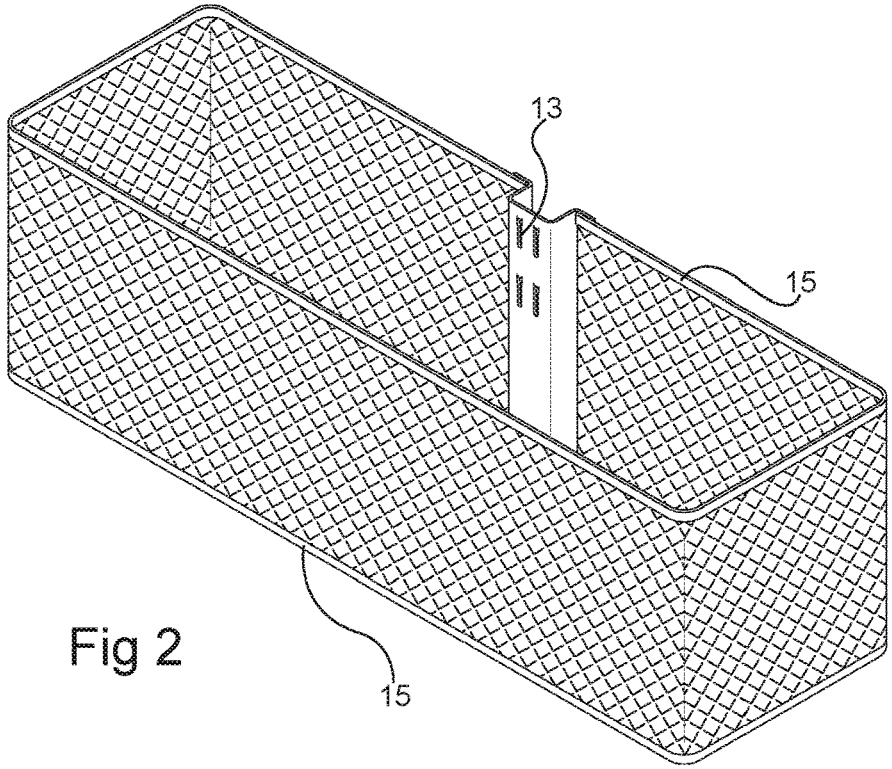

FIG. 2 illustrates a version of the storage device with increased depth. As illustrated, a hook unit with four hooks 13 may still be used although it is possible to increase the number of hooks, as the fastening device has more room available. As shown in FIG. 2 and in FIG. 1 as well, there may be provided unstretched (and not sheared) areas 15 e.g. at the top and bottom edges of the rear, front and side walls 3, 5, 7 which facilitates manufacturing. At these locations, the sheet metal material may be folded to provide edges completely free from burrs and the like.

Unlike a metal wire basket, the mesh basket will have uniform thickness and provide a relatively smooth surface while still being ventilated and to some extent transparent. However, in a wire basket load may be distributed from thicker wires, attached to the fastening device, to thinner wires, in a way which is not possible in a mesh basket. Therefore, attaching the mesh structure to the fastening device requires attention to achieve a similar capability of carrying heavy items.

Figure 3:
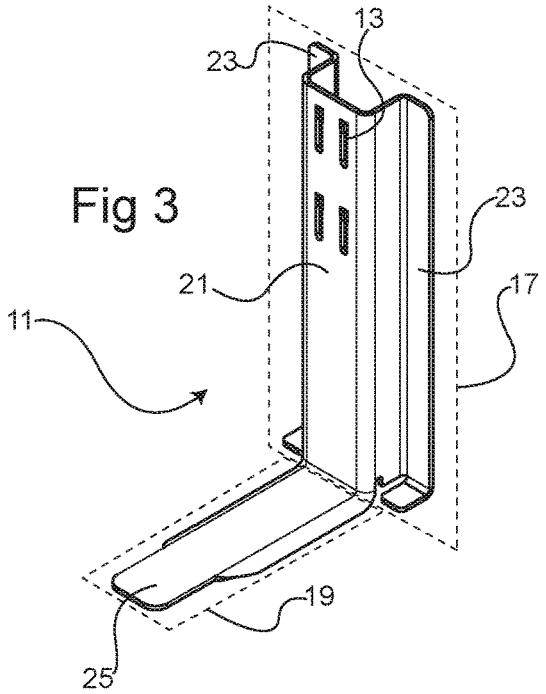
FIG. 3 shows a perspective view of a fastening device suitable for the storage device of FIG. 2.

FIG. 3 shows a perspective view of a generally L-shaped fastening device 11 suitable for the storage device of FIG. 2. The fastening device has a vertical section 17 and a horizontal section 19, where the horizontal section is intended to support the bottom piece 9 of the storage device. As can be seen in FIG. 3, the fastening device 11 can be made in one piece from sheet metal that is punched and bent into the desired shape. In order to fit snugly over the vertical carrier elements, the horizontal section 19 has a connector part 21 with U-shaped cross section having two wings or flanges 23 extending perpendicularly from the legs of the "U". The connector part 21 includes the aforementioned hooks 13 for connecting the fastening device to a vertical carrier element, and the flanges 23 provide surfaces where the mesh material of the container's rear wall 5 can be attached e.g. by spot welding. The horizontal section 19 supports the bottom piece 9 of the storage device by providing a reinforced unit or tongue 25 reaching out under the bottom piece to take up load therefrom.

Figure 4:
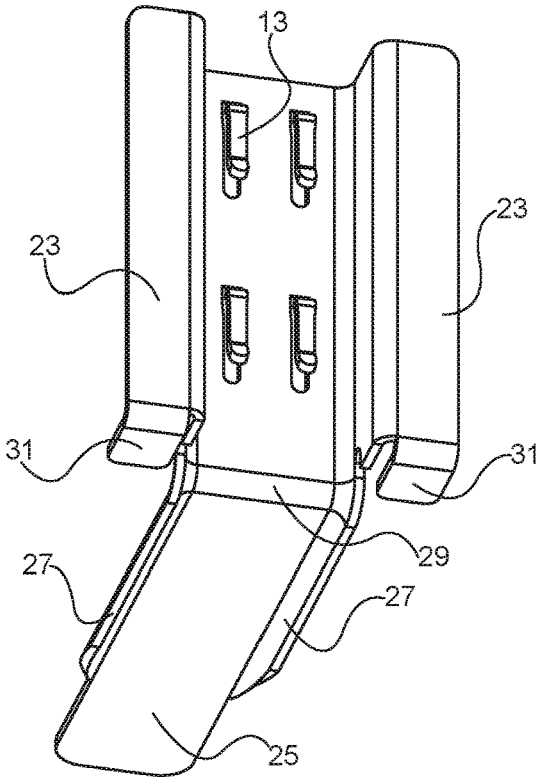
FIG. 4 shows a perspective view as seen from below and behind of a fastening device suitable for the storage device of FIG. 1.

FIG. 4 shows a perspective view as seen from below and behind of a fastening device suitable for the storage device of FIG. 1. As illustrated, the extending tongue 25 may have reinforcing flanges 27 extending downwards from the plane of the tongue 25 at the sides thereof. These flanges may be a continuation of the legs of the U-shaped cross section of the connector part 21 that proceed through the bend 29 that make up the generally L-shaped fastening part.

The flanges 23 of the connector part 21 may at their lower ends have bent portions 31 that are bent towards the mesh basket to facilitate the attaching of said basket.

FIG. 4 further illustrates the hooks 13 more clearly. In the shown example, the hooks 13 are formed by punching tongues in the centre piece of the connector part. These tongues are subsequently bent to be parallel shifted inwards in the U-shaped cross section such that they can be inserted in the vertical carrier, and the tip of each tongue is bent further inwards to facilitate this insertion.

FIGS. 5-7 show different perspective views of a storage device attached to a vertical carrier element or rod. FIG. 5 shows a perspective as seen from below, where it is clear that the tongue reaches out almost all, more than 90%, of the depth of the bottom panel 9 as seen from the connector part to provide improved stability and load carrying capability.

FIG. 6 shows a view from the rear of the basket illustrating, in the enlarged section how the hooks 13 of the connector part reaches into the slots of the vertical carrier element.

As illustrated in FIG. 7, the connector part 21 may be fully contained within the outer envelope of the basket. This means that when the carrier element is attached to a wall and the U-shaped portion of the connector part encloses the carrier element, the back panel 5 of the basket may rest against the wall which serves to keep the basket firmly in place, even if it extends substantially sideways, and even if there would be a slight play between the connector element and the carrier element.

Figure 8:
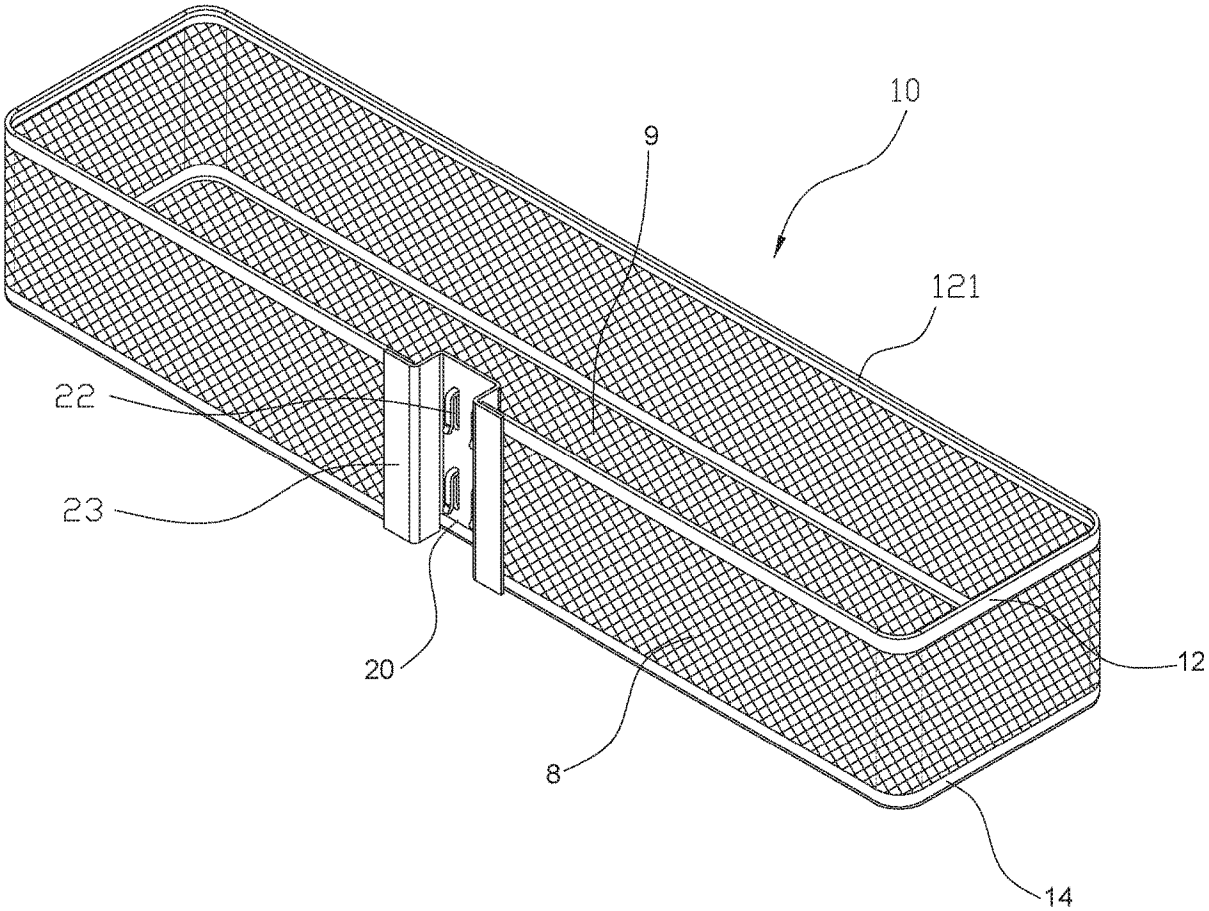
FIG. 8 illustrates a three-dimensional view of the basket in the present invention.
Figure 9:
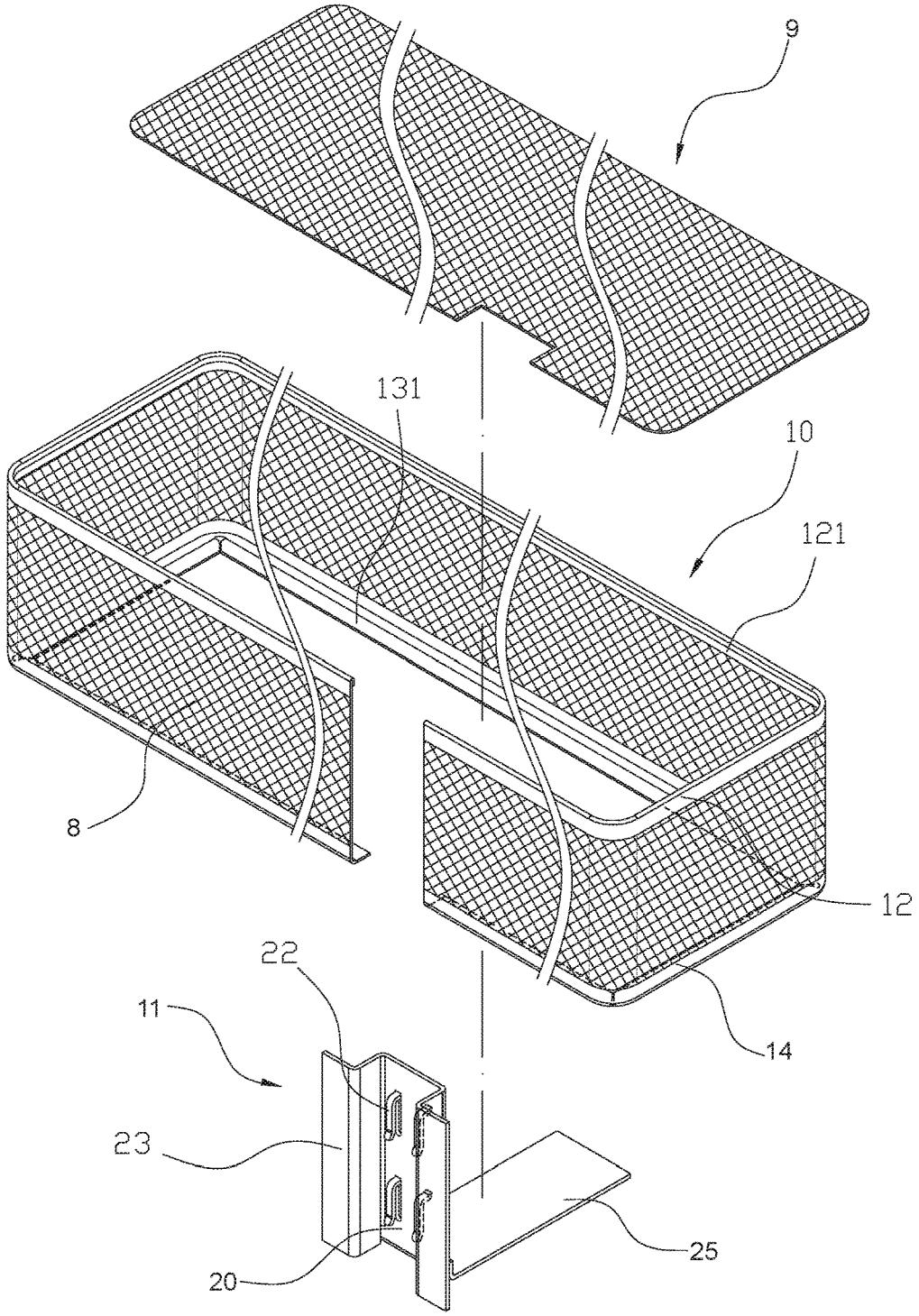
FIG. 9 illustrates an exploded view of the basket in the present invention.
Figure 10:
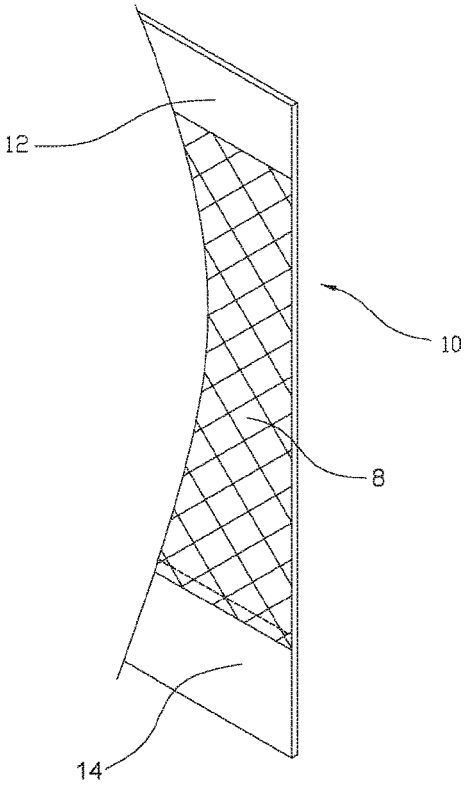
FIG. 10 illustrates a partial enlarged view of the side frame before being bent in the present invention.
Figure 17:
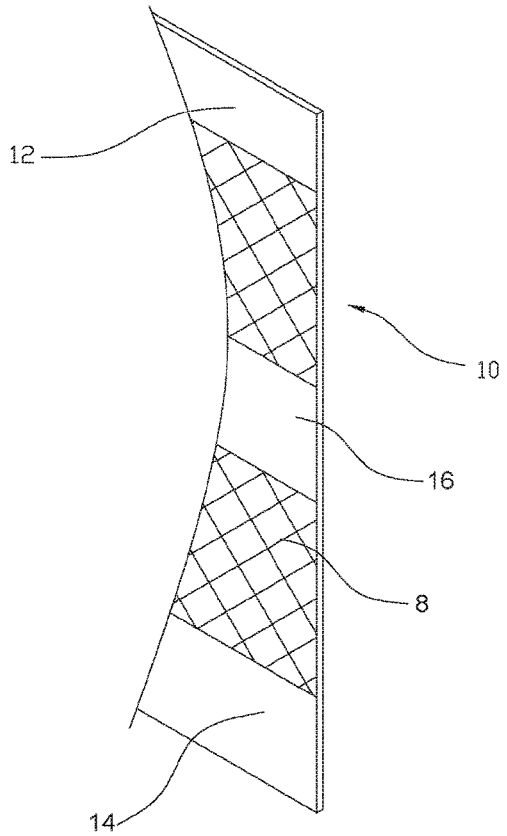
FIG. 17 illustrates a partial enlarged view of the further embodiment in the present invention.
Figure 11:
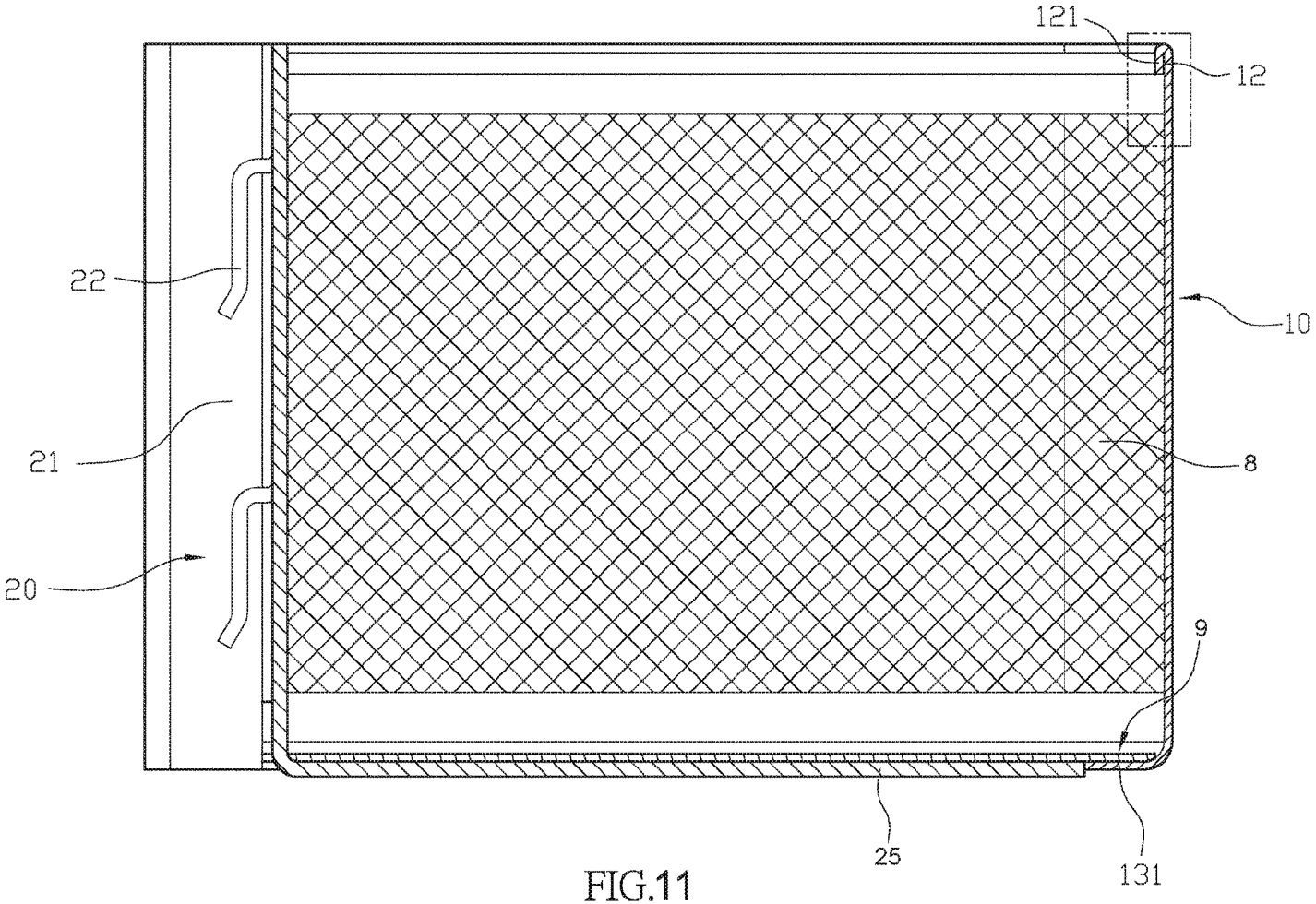
FIG. 11 illustrates a sectional view of the basket in the present invention.
Figure 12:
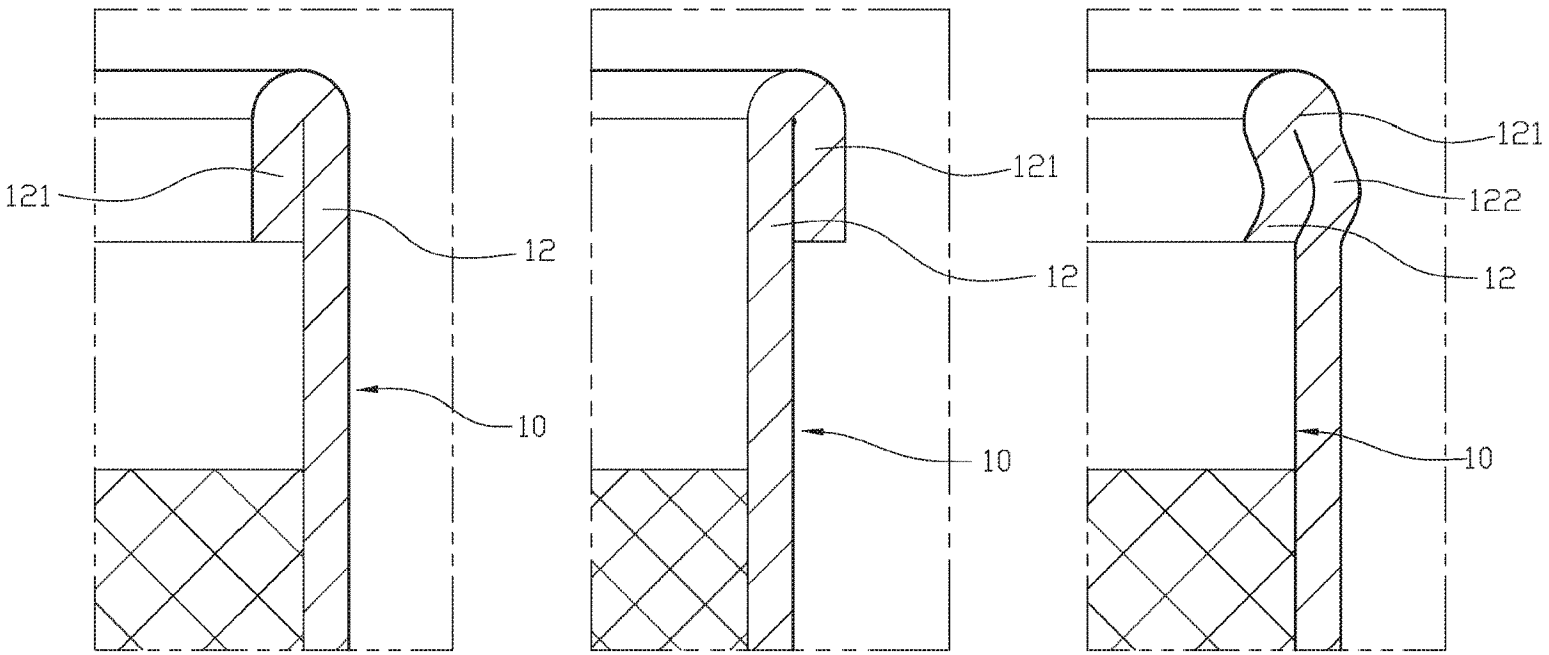
FIG. 12 illustrates a schematic view of the upper board bent inward and outward in the present invention.
Figure 13:
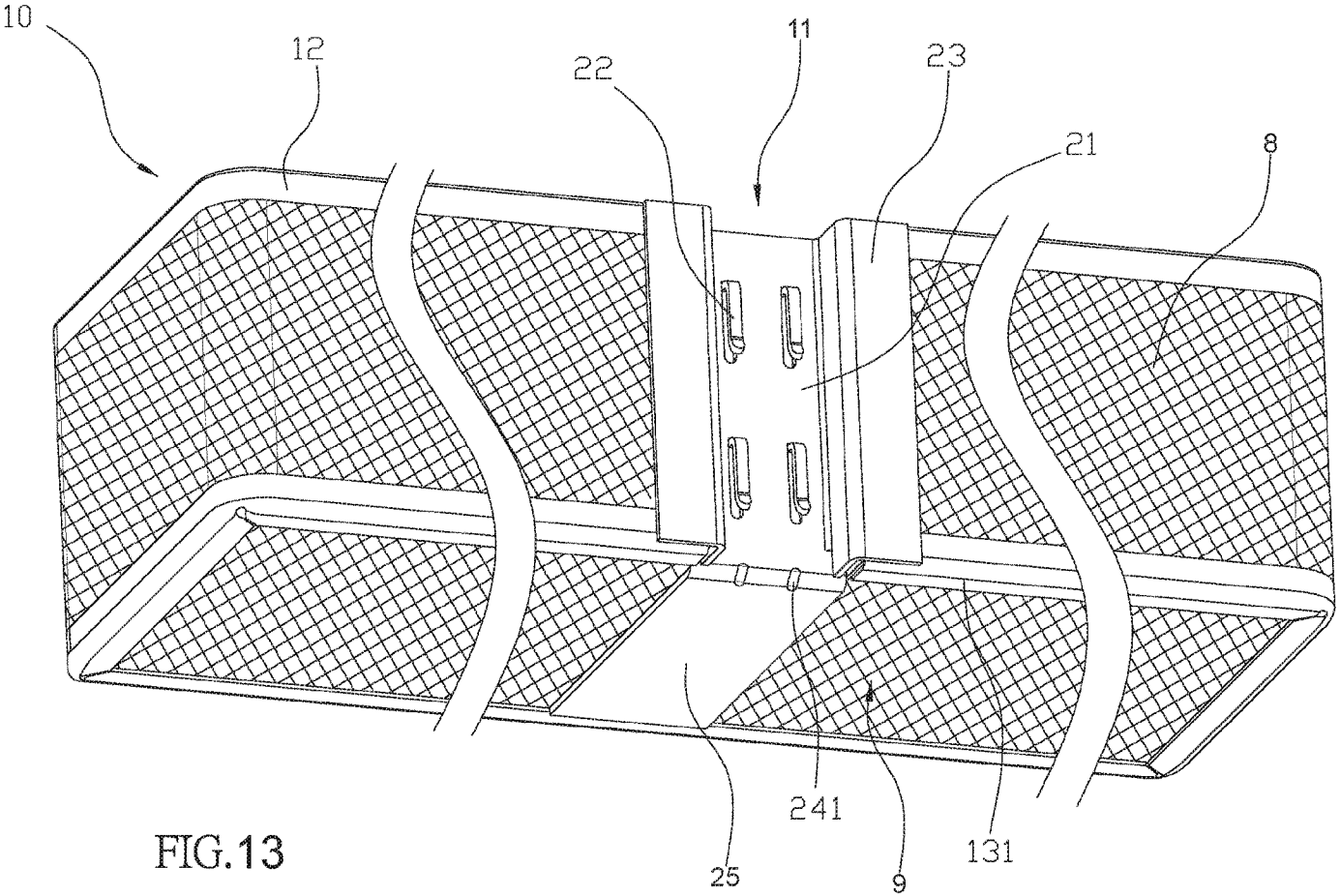
FIG. 13 illustrates a three-dimensional view of the basket in the present invention from another angle.

Referring to FIGS. 8 to 10, a basket may include a basket frame 10, a hook assembly 11 and a bottom 9. The basket frame 10 has a meshed unit 8, and an upper board 12 and lower board 14 extending from the meshed unit 8. The upper board 12 has a side frame 121 with reversed U shape, and the lower board 14 has an L-shaped portion 131. It is noted that the side frame 121 can be either bent inside or outside (see FIGS. 11 and 12), and a protruding unit 122 is disposed on the side frame 121 to increase the structural strength. The hook assembly 11 is disposed at a predetermined position on the basket frame 10. The hook assembly 11 has a recessed engaging slot 20 and a hook unit 22 on the surface thereof. A wing 23 extends from both sides of the hook assembly 11, and is disposed on both ends of the basket frame 10 to connect the basket frame 10. A reinforced unit 25 is disposed at a bottom portion of the hook assembly 11, and the reinforced unit 25 and the hook assembly 11 are formed as an L-shaped unit as shown in FIG. 13. A reinforced point 241 is formed at the bent portion of the L-shaped unit. It is noted the reinforced unit 25 is a board to connect the L-shaped portion 131 of the basket frame 10. The bottom 9 is a meshed board corresponding to the L-shaped portion 131 of the basket frame 10.

Referring to FIGS. 8, 9, 11 and 13, the basket frame 10 can be divided into two bent units, and two ends of the bent units can be provided for the hook assembly 11. More specifically, the wings 23 of the hook assembly are secured at two ends of the basket frame 10. The bottom portion of the hook assembly 11 has a reinforced unit 25 to connect the L-shaped portion 131 of the basket frame 10, so the structural strength of the basket frame 10 can be enhanced by the reinforced unit 25. Finally the bottom 9 is disposed inside the basket frame 10 above the L-shaped portion 131 to complete the assembly process of the basket.

Figure 14:
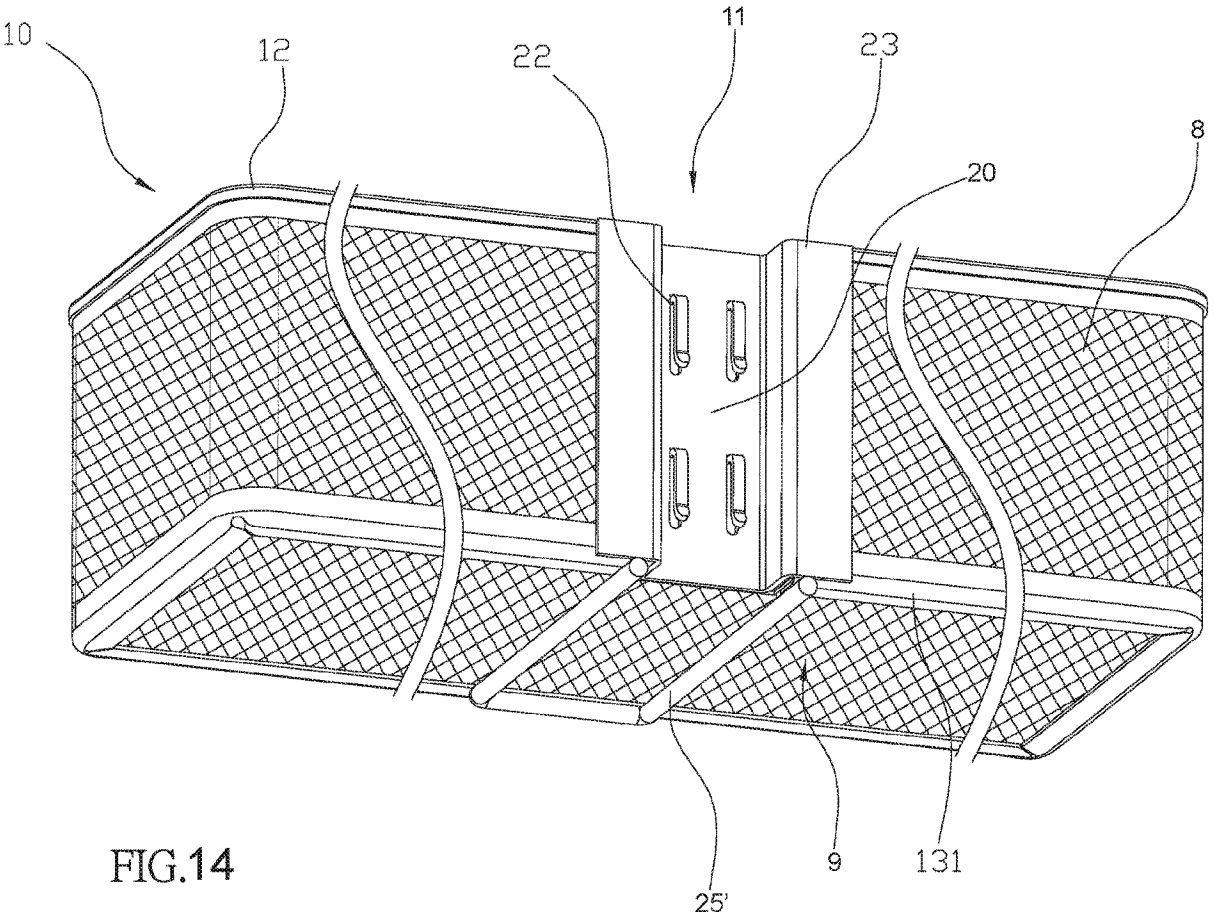
FIG. 14 illustrates another embodiment in the present invention.

In another embodiment, the reinforced unit 25 of the hook assembly 11 is a U-shaped unit to connect the L-shaped unit 131 of the basket frame 10, as shown in FIG. 14.

Figure 15:
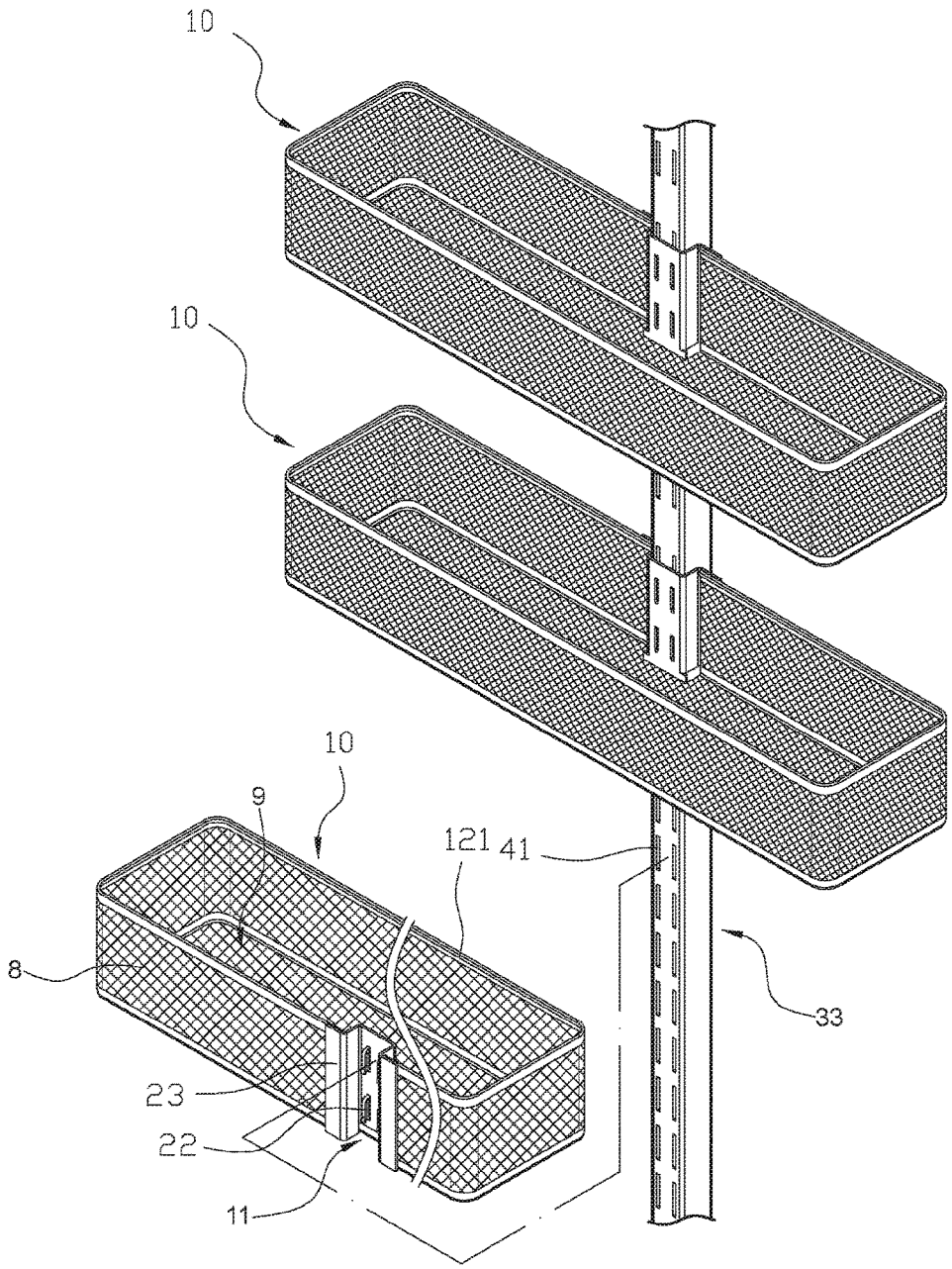
FIG. 15 illustrates a schematic view of the basket in use in the present invention.
Figure 16:
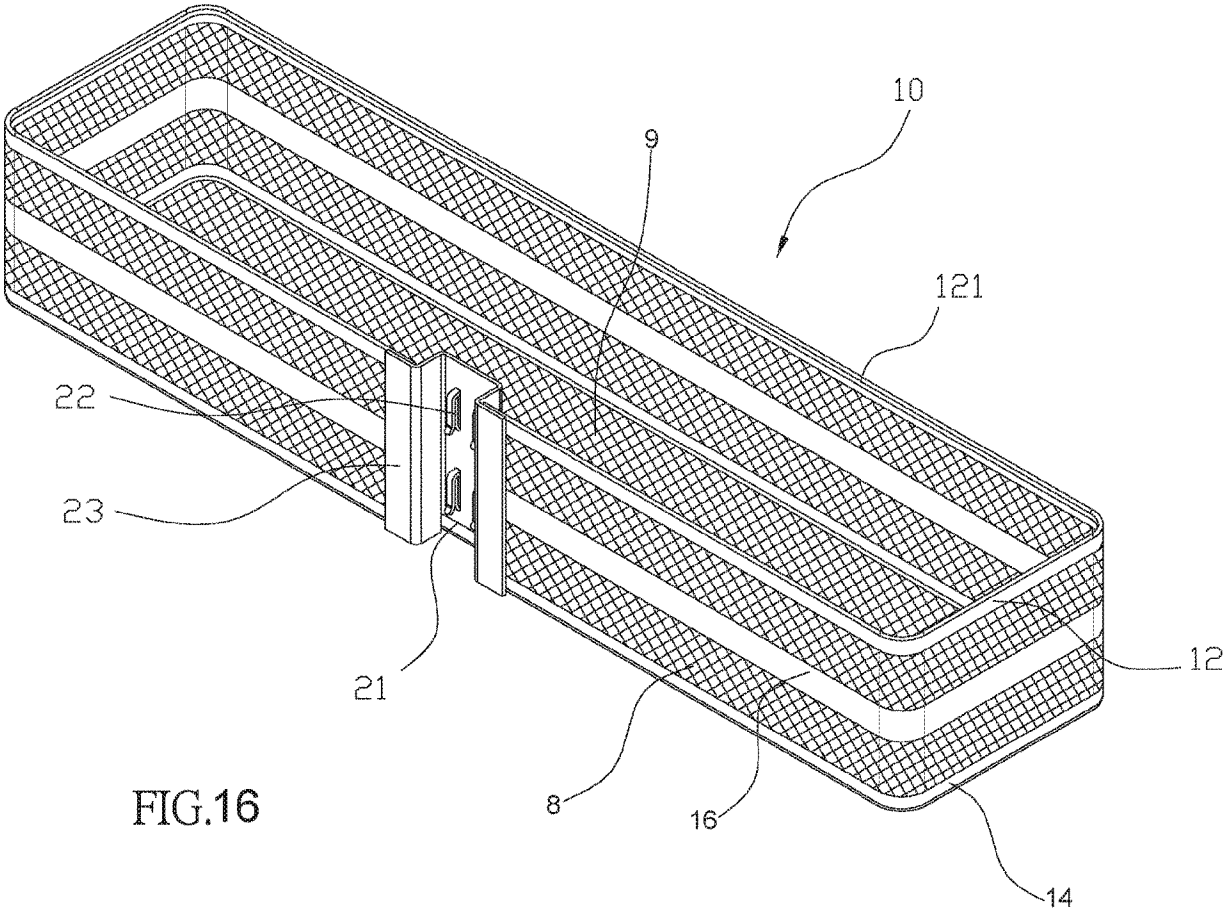
FIG. 16 illustrates a further embodiment in the present invention.

Referring to FIG. 15, the basket can be hung on a rod 33 through the hook assembly 11. More specifically, the basket can be hung on the rod 33 through the hook unit 22 of the hook assembly 11 engaging with engaging holes 41 of the rod 33 to secure the basket. Similarly, the structural strength of the basket frame 10 can be enhanced by the reinforced unit 25.

In a further embodiment, a solid surrounding board 16 is disposed on the meshed unit 8 to enhance the structural strength of the meshed unit 8.

According to the embodiments mentioned above, the present invention is advantageous because (1) the basket frame 10 is made in one piece to avoid soldering, which would decrease the structural strength of the basket, and (2) the upper board 12 has a side frame 121 with reversed U shape and the lower board 14 has an L-shaped portion 131 to enhance the structural strength of the basket frame 10, so the bottom 9 can sustain heavier objects. Also, the basket frame 10 and the bottom 9 are all meshed, the objects are unlikely to fall out from the basket.

Having described the invention by the description and illustrations above, it should be understood that these are exemplary of the invention and are not to be considered as limiting. Accordingly, the invention is not to be considered as limited by the foregoing description, but includes any equivalents.

The following embodiments have been considered:

1. A basket comprising: a basket frame having a meshed unit, and an upper board and lower board extending from the meshed unit, said upper board having a side frame with reversed U shape and the lower board having an L-shaped portion; a hook assembly disposed at a predetermined position on the basket frame and having a reinforced unit disposed at a bottom portion of the hook assembly to secure the L-shaped portion; and a bottom, which is a meshed board corresponding to the L-shaped portion of the basket frame.

2. The basket of embodiment 1, wherein the side frame is configured to bend inwardly.

3. The basket of embodiment 1, wherein the side frame is configured to bend outwardly.

4. The basket of embodiment 1, wherein a protruding unit is disposed on the side frame to increase the structural strength.

5. The basket of embodiment 1, wherein the hook assembly has a recessed engaging slot and a hook unit on the surface thereof, and a wing extends from both sides of the hook assembly, and is disposed on both ends of the basket frame to connect the basket frame.

6. The basket of embodiment 1, wherein the reinforced unit is a board to connect the L-shaped portion of the basket frame.

7. The basket of embodiment 6, wherein a reinforced point is formed at the bent portion of the L-shaped unit.

8. The basket of embodiment 1, wherein the reinforced unit of the hook assembly is a U-shaped unit to connect the L-shaped unit of the basket frame.

9. The basket of embodiment 1, wherein a solid surrounding board is disposed on the meshed unit to enhance the structural strength of the meshed unit.

The invention claimed is:

1. Storage device comprising a basket and a fastening device attached thereto, the fastening device having a portion with a U-shaped cross section provided with hooks in an interior of the U-shaped cross-section, such that the fastening device can be fitted on a vertical carrier provided with slots, the hooks entering said slots, and wherein the fastening device is at least partly inserted in an outer envelope of the basket, the basket being formed by expanded metal mesh panels, and the fastening device having a portion extending under a bottom panel of the basket.

2. A storage device according to claim 1, wherein the fastening device is made in one piece of sheet metal having a vertical section and a horizontal section, provided with a tongue, defining the portion extending under the bottom panel, and a bend (29) therebetween.

3. A storage device according to claim 2, wherein the U-shaped form of the vertical section partly continues past the bend such that reinforcement flanges are provided at least along a part of the tongue, and extending out of the plane of the tongue.

4. A storage device according to claim 2, wherein the tongue extends to at least half of the basket bottom panel's depth.

5. A storage device according to claim 1, wherein unstretched areas are provided at top or bottom edges of the mesh panels, of the front, rear and side panels of the basket.

6. A storage device according to claim 2, wherein unstretched areas are provided at top or bottom edges of the mesh panels of the front, rear and side panels of the basket.

7. A storage device according to claim 3, wherein unstretched areas are provided at top or bottom edges of the mesh panels of the front, rear and side panels of the basket.

8. A storage device according to claim 4, wherein unstretched areas are provided at top or bottom edges of the mesh panels of the front, rear and side panels of the basket.

9. A storage device according to claim 1, wherein the fastening device is made in one piece of sheet metal having a vertical section and a horizontal section, provided with a tongue, defining the portion extending under the bottom panel, and a bend therebetween;

wherein the U-shaped form of the vertical section partly continues past the bend such that reinforcement flanges are provided at least along a part of the tongue, and extending out of the plane of the tongue; and wherein the tongue extends to at least half of the basket bottom panel's depth.

10. A storage device according to claim 9, wherein unstretched areas are provided at top or bottom edges of the mesh panels of the front, rear and side panels of the basket.

11. Storage device comprising:

a basket formed by expanded metal mesh panels, the basket having front, rear, side and bottom mesh panels;

a fastening device attached to the basket, the fastening device having a vertical section and a horizontal section;

wherein the vertical section comprises a portion with a U-shaped cross section provided with hooks in an interior of the U-shaped cross section, such that the fastening device can be fitted on a vertical carrier provided with slots, the hooks entering said slots and being at least partly inserted in an outer envelope of the basket; and wherein the horizontal section of the fastening device comprising a tongue portion extending under the bottom mesh panel of the basket.

12. A storage device according to claim 1, wherein reinforcement flanges are provided at least along a part of the tongue and extending out of the plane of the tongue.

13. A storage device according to claim 11, wherein the tongue extends to at least half of the basket bottom panel's depth.

14. A storage device of claim 11, wherein the vertical and horizontal sections of the fastening device are made in one piece of sheet metal having a vertical section and a horizontal, with a bend therebetween.

15. A storage device of claim 14, wherein the U-shaped cross-section transitions past the bend to reinforcement flanges along at least part of the tongue, extending out of the plane of the tongue.

16. A storage device of claim 6, wherein unstretched areas are provided at top or bottom edges of the mesh panels of the front, rear and side panels of the basket.

* * * * *